US006523836B1

(12) United States Patent
Chang et al.

(10) Patent No.: US 6,523,836 B1
(45) **Date of Patent: *Feb. 25, 2003**

(54) WHEEL ASSEMBLY FOR ROLLER SKATE

(75) Inventors: Chun-Cheng Chang, No. 492-16, Chia-Li Hsing, Chia-Li Town, Tainan Hsien (TW); Hong-Young Chiu, Tainan Hsien (TW)

(73) Assignee: Chun-Cheng Chang, Tainan Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/964,524

(22) Filed: Sep. 28, 2001

(51) Int. Cl.[7] ..... A63C 17/00

(52) U.S. Cl. ..... 280/11.223; 280/7.13; 280/11.26; 280/11.27

(58) Field of Search ..... 280/7.13, 11.211, 280/11.207, 11.209, 11.215, 11.208, 11.19, 9, 11.223; 36/115

(56) References Cited

U.S. PATENT DOCUMENTS 3,884,485 A * 5/1975 Walle ..... 180/11
3,979,842 A * 9/1976 Texidor ..... 36/115
3,983,643 A * 10/1976 Schreyer ..... 36/115
4,333,249 A * 6/1982 Schaefer ..... 36/115
4,372,566 A * 2/1983 Smith ..... 280/11.19
4,928,982 A * 5/1990 Logan ..... 290/11.22
5,398,970 A * 3/1995 Tucky ..... 280/11.19
5,511,824 A * 4/1996 Kim ..... 280/11.19
5,785,327 A * 7/1998 Gallant ..... 280/11.27
5,797,609 A * 8/1998 Fichepain ..... 280/11.19
5,882,018 A * 3/1999 Petrosino ..... 280/7.13
5,887,898 A * 3/1999 Petrosino ..... 280/825
6,042,125 A * 3/2000 Wu ..... 280/11.27
6,065,759 A * 3/2000 Wu ..... 280/11.115
6,086,072 A * 7/2000 Prus ..... 280/11.28
6,120,039 A * 9/2000 Clementi ..... 280/11.19
6,247,708 B1 * 6/2001 Hsu ..... 280/11.223
6,254,109 B1 * 7/2001 Horton ..... 280/2.14
6,308,964 B1 * 10/2001 Chang ..... 280/11.19
6,336,644 B1 * 1/2002 Chu ..... 280/11.233

* cited by examiner

*Primary Examiner*—Brian L Johnson
*Assistant Examiner*—Kelly E Campbell
(74) *Attorney, Agent, or Firm*—Bacon & Thomas, PLLC

(57) ABSTRACT

A wheel assembly for a roller skate. The wheel assembly mainly includes a pivotal seat, a singular locking member and a wheel set. The pivotal seat includes a first end pivotally connected to a sole base by a mounting member for convertibly moving between a stowed position and an extended position and a second end rotatably connected to the wheel set for skating. The singular locking member is adapted to optionally position the pivotal seat either in the stowed position or in the extended position. The singular locking member includes a main plate being adapted to structurally engage with the sole base and two teeth being adapted to lock or unlock the pivotal seat either in the stowed position or in the extended position. The wheel assembly further includes a button being adapted to actuate the singular locking member to unlock the pivotal seat.

8 Claims, 4 Drawing Sheets

WHEEL ASSEMBLY FOR ROLLER SKATE

BACKGROUND OF THE INVENTION

1. Field of the Invention

The present invention is related to a wheel assembly for roller skate and more particularly to a singular locking member in order to simplify entire structure of the wheel assembly and to ensure operational reliability of the wheel assembly.

2. Description of the Related Art

The technology trend in skates manufacturing has been toward convertible shoes. Convertible shoes capable of converting from walking shoes into skates are known in the art. Convertible wheel seats are integral with and fixed to the known convertible shoe. Therefore, a need exists for improved the construction of integrated convertible shoes and facilitating their operation.

U.S. patent application Ser. No. 09/666,454 filed on Sep. 21, 2000 discloses ase Structure for Roller Skates The base structure comprise a base having at least two compartments, a bottom plate secured to the base, and a plurality of wheel assemblies each of which is mounted in the associated compartment. The bottom plate includes a plurality of blocks formed on the under side thereof, each block being received in the associated compartment. Each wheel assembly includes a pivotal seat having a first end secured to the underside of the bottom plate, a wheel seat having a first end pivotally connected to a second end of the pivotal seat, and a wheel rotatably mounted to a second end of the wheel seat. Each wheel seat may be pivoted to a storage position in the associated compartment when not in use. When skating is required, each wheel seat is pivoted to an operative position, in which each wheel seat bears against an underside of an associated block while the wheel rotatably attached to each wheel seat extends beyond the base for skating. Furthermore, the base structure also comprises a first elastic member having a first end attached to the pivotal seat and a second end attached to a mounting member on the wheel seat for biasing the wheel seat to the storage position in the base. A stopping means includes a first end mounted to the pin and a second end through which the mounting member is extended. A second elastic member is mounted around the pin for being adapted to bias a stop of the stopping means to a position for releasably engaging with the wheel seat to prevent the wheel seat from moving into the storage position in the base while the wheel seat and the wheel are extended beyond the base for skating. However, the elements of the wheel assembly, such as the first elastic member, the second elastic member and the stopping means, increase complexity of the entire structure of the wheel assembly and cost of manufacture. Meanwhile, the wheel assembly also requires several operational/assembling steps for manufacture.

The present invention intends to provide a singular locking member optionally positioning a wheel assembly either in a stowed position or in an extended position in such a way to mitigate and overcome the above problem.

SUMMARY OF THE INVENTION

The primary objective of this invention is to provide a wheel assembly for roller skate including a singular locking member adapted being used to optionally position the wheel assembly in order to reduce elements and to simplify entire structure of the wheel assembly.

The secondary objective of this invention is to provide the wheel assembly for roller skate including a singular locking member that can reduce operational/assembling steps in manufacture process.

The another objective of this invention is to provide the wheel assembly for roller skate including a singular locking member adapted being structurally engaged with a sole base in order to ensure operational reliability.

The present invention is the wheel assembly for roller skate. The wheel assembly mainly comprises a pivotal seat, a singular locking member and a wheel set. The pivotal seat includes a first end pivotally connected to a sole base by a mounting member for convertibly moving between a stowed position and an extended position and a second end rotatably connected to the wheel set for skating. The singular locking member is adapted to optionally position the pivotal seat either in the stowed position or in the extended position. The singular locking member comprises a main plate being adapted to structurally engage with the sole base and two teeth being adapted to lock or unlock the pivotal seat either in the stowed position or in the extended position. The wheel assembly further comprises a button being adapted to actuate the singular locking member to unlock the pivotal seat.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings herein.

DETAILED DESCRIPTION OF THE INVENTION

Figure 1:
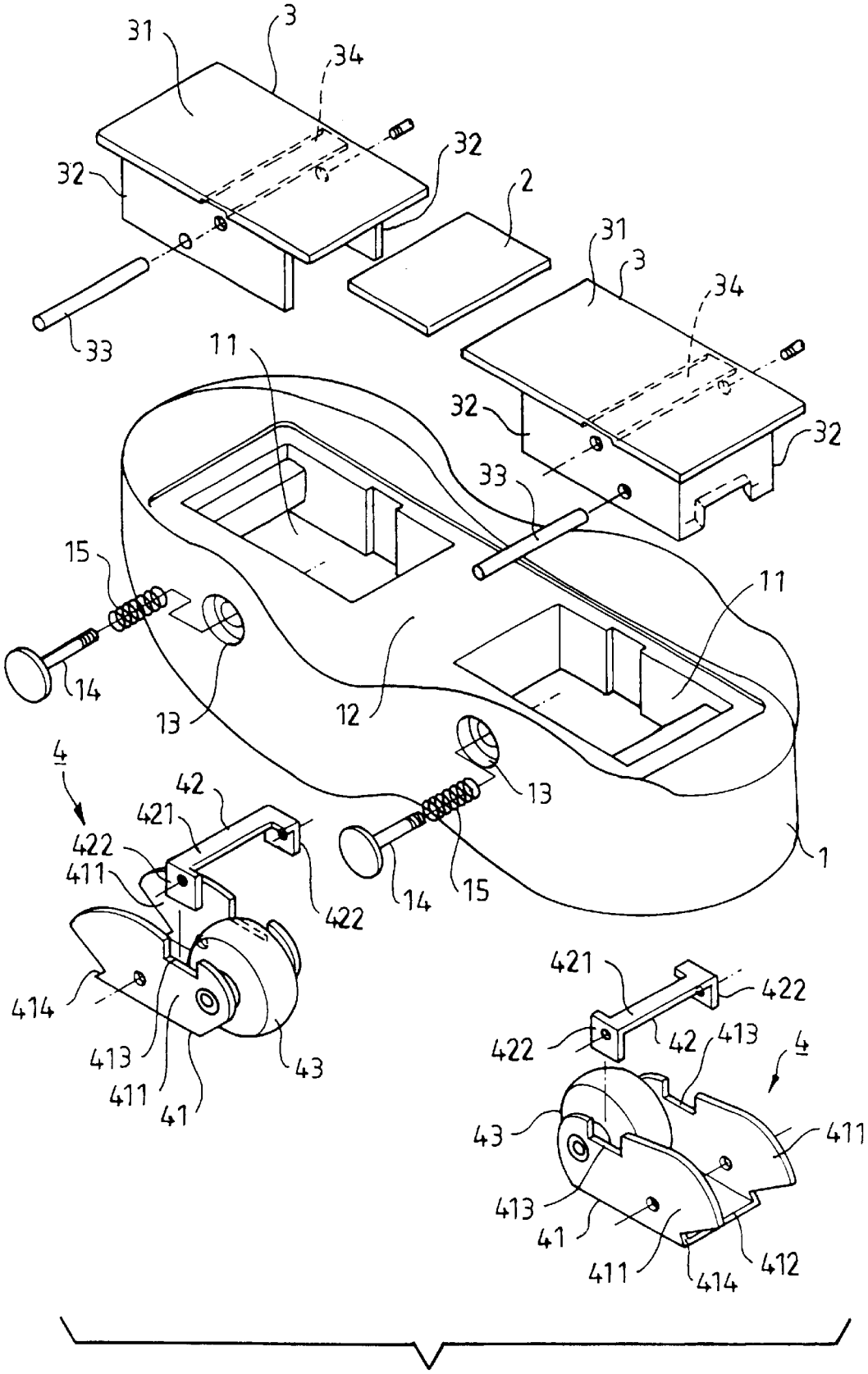
FIG. 1 is an exploded perspective view of the roller skate in accordance with an embodiment of the present invention.

Referring now to the drawings, there is an embodiment of the present invention shown therein, which include generally a primary sole member and a secondary shoe member (in dotted line).

Figure 2:
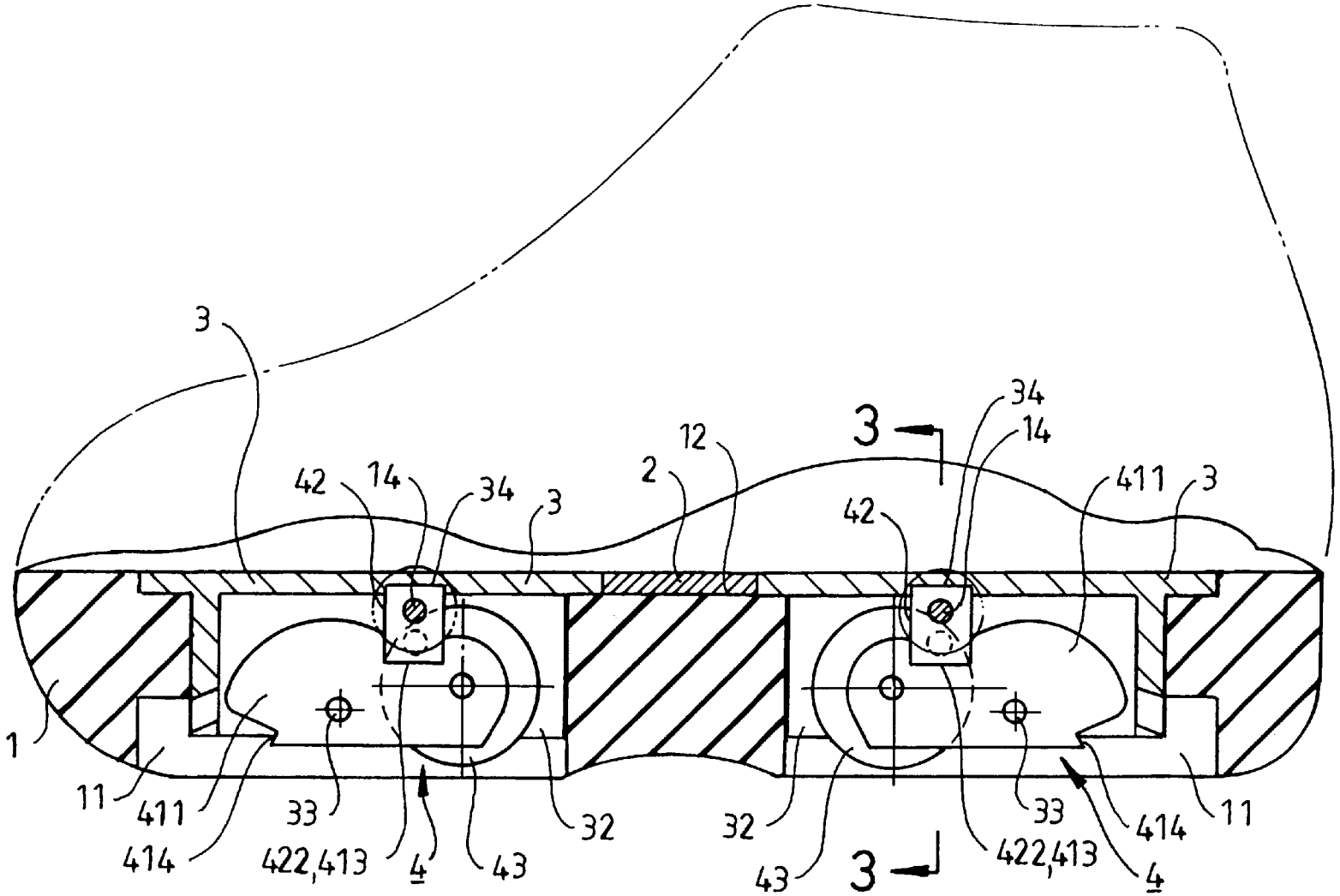
FIG. 2 is a partial cross-sectional view of the roller skate locked in a stowed position in accordance with the embodiment of the present invention.

Referring initially to FIGS. 1 and 2, a roller skate in accordance with the present invention generally includes a sole designated as numeral 1, a sole-pad designated as numeral 2, a pair of bases designated as numeral 3 and a pair of wheel assemblies designated as numeral 4. The sole 1 comprises two cavities 11 each having an opening defined therein and an upper side 12 mounted a sole-pad 2 between the two cavities 11. Each cavity 11 further provides a hole 13 connected with the outer circumference of the sole 1. A button 14 has a first end exposed on the outer circumference of the sole 1 and a second end extended into the cavity 11. A spring 15 is mounted around the button 14. The bases 3 are mounted in the associated cavity 11, which can functionally stow, extract and lock the wheel assembly 4. The base 3 comprises an upper wall 31 and an annular sidewall 32 on which providing two holes pivotally received a mounting member 33 and a groove 34 extended on the inner circumference of the upper wall 31.

Construction of the wheel assembly 4 shall be described in detail, referring now to FIGS. 1 and 2. The wheel assembly for roller skate in accordance with an embodiment of the present invention mainly includes a pivotal seat 41, a singular locking member 42 and a wheel set 43. The pivotal seat 41 is formed from a frame having at least one arm 411, preferably having two arms 411 which are parallel to a common plane and connected by an upper wall 412. The arm 411 comprises two recessed edges 413 and 414 at predetermined positions. The pivotal seat 41 comprises a first end pivotally connected to the base 3 by the mounting member 33 for convertibly moving between a stowed position and an extended position and a second end rotatably connected to the wheel set 43 for skating. The singular locking member 42 is formed from an elongated frame having a main plate 421 and at least one tooth 422, preferably two teeth 422. When assembled, the main plate 421 of the singular locking member 42 and the groove 34 of the base 3 are longitudinally combined so that the singular locking member 42 is confined within the groove 34 and longitudinally slides between at a locking position and at a unlocking position. As previously mentioned, the pivotal seat 41 is pivotally connected to the base 3 and then optionally locked either in the stowed position or in the extended position.

Figure 3:
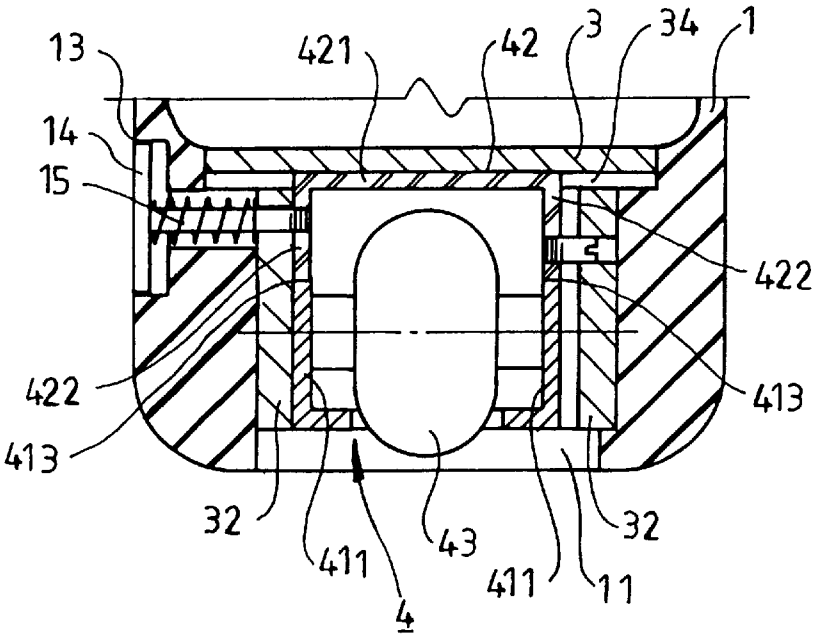
FIG. 3 is a cross-sectional view, taken along 3—3 in FIG. 2, of the roller skate in accordance with the embodiment of the present invention.

Stowed operation of the wheel assembly 4 shall now be described with reference to FIGS. 1 through 3. In the stowed position, when the pivotal seat 41 is moved backward to the stowed position into the cavity 11, the recessed edge 413 approaches to the singular locking member 42. As the pivotal seat 41 is moved backward to a predetermined position, the tooth 422 of the singular locking member 42 is releasably engaged with the recessed edge 413 of the pivotal seat 41 such that the entire wheel assembly 4 is locked in the stowed position into the cavity 11 of the sole 1. The singular locking member 42 locks the pivotal seat 41 to prevent from returning to the extended position.

Figure 4:
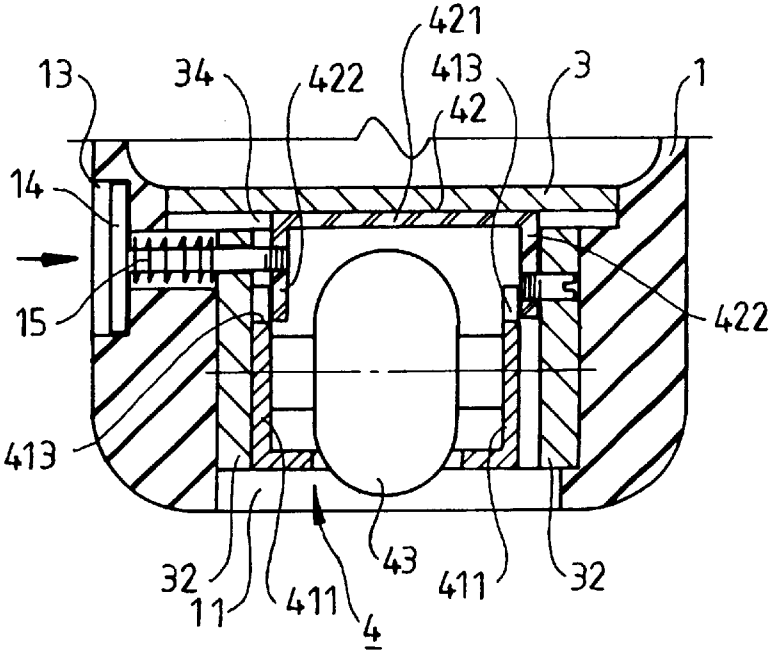
FIG. 4 is a partial cross-sectional view of the singular locking member of the roller skate being pressed to unlock in the stowed position similar to FIG. 3 in accordance with the embodiment of the present invention.

Unlocked operation of the wheel assembly 4 shall now be described with reference to FIG. 4. It is still situated in the initial stowed position. As can be seen in FIG. 4, the button 14 is axially pressed to move an adequate distance along the hole 13 so that the tooth 422 of the singular locking member 42 releases the recessed edge 413 of the pivotal seat 41. The pivotal seat 41 can be convertably moved from the stowed position to the extended position out of the cavity 11 of the sole 1.

Figure 5:
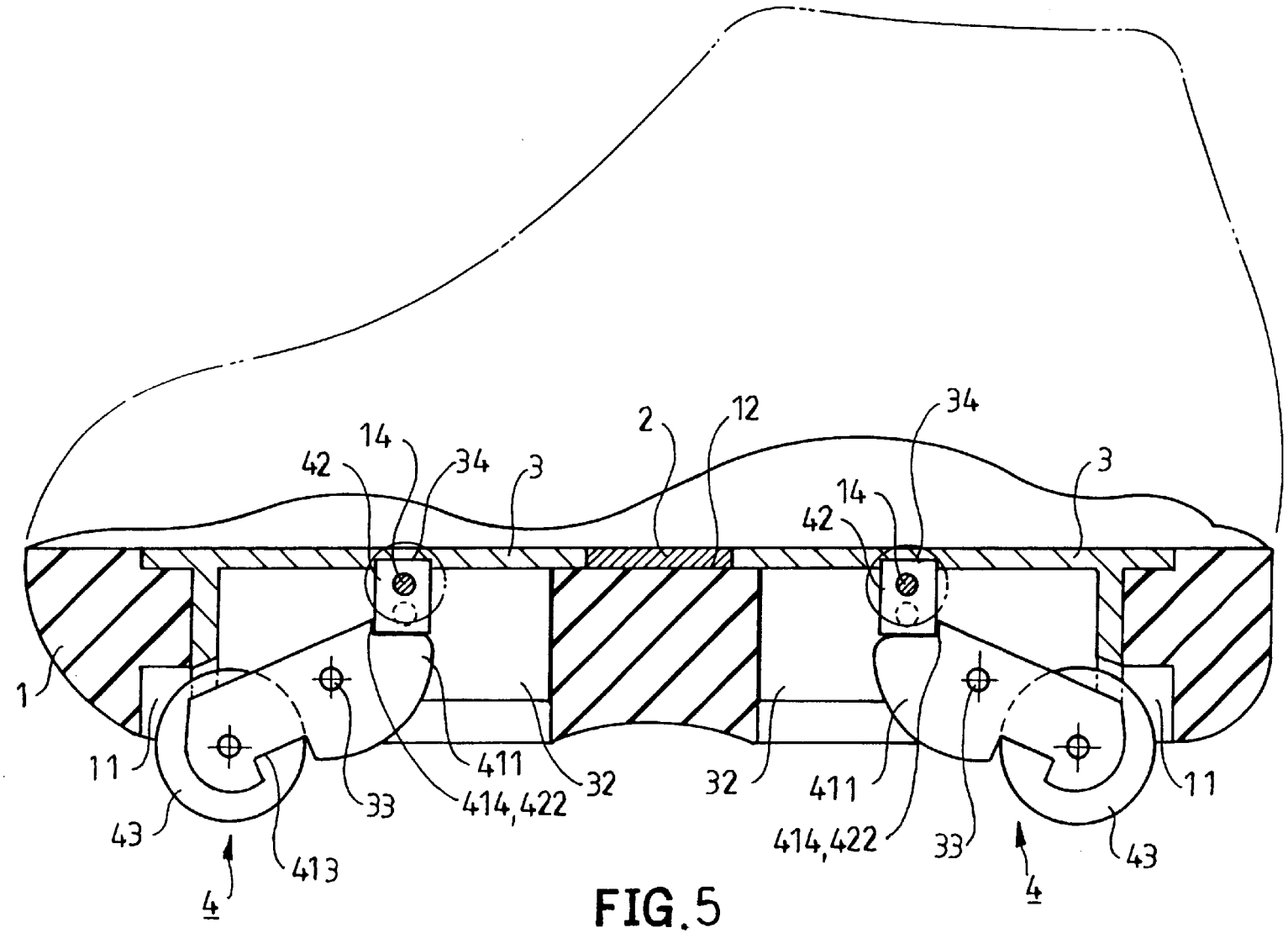
FIG. 5 is a partial cross-sectional view of the roller skate locked in an extended position similar to FIG. 2 in accordance with the embodiment of the present invention.

Extended operation of the wheel assembly 4 shall now be described with reference to FIGS. 4 and 5. When the pivotal seat 41 is moved forward to the extended position, the singular locking member 42 maintains in released relationship with the pivotal seat 41. As the pivotal seat 41 is moved forward to a predetermined position, the teeth 422 of the singular locking member are releasably engaged with the recessed edge 414 of the pivotal seat 41 such that the entire wheel assembly 4 is locked in the extended position out of the cavity 11 of the sole 1.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A wheel assembly for roller skate incorporating into a cavity of a sole, which includes:

a pivotal seat comprising a first end pivotally connected to a base for convertably moving between a stowed position and an extended position and a second end;

a singular locking member comprising at least one tooth being optionally adapted to releasably lock the pivotal seat either in the stowed position or in the extended position; and a wheel set rotatably connected to the second end of the pivotal seat for skating wherein the pivotal seat provides two recessed edges at predetermined positions to releasably engage with the tooth of the singular locking member so that the pivotal seat can be optionally locked either in a stowed position or in an extended position.

2. The wheel assembly for roller skate as defined in claim 1, wherein the base provides a groove to slidably engage with a main plate of the singular locking member.

3. The wheel assembly for roller skate as defined in claim 1, wherein the singular locking member forms from an elongated frame.

4. The wheel assembly for roller skate as defined in claim 1, further comprises a button is adapted to actuate the singular locking member and extended into a hole connected to the cavity of the sole.

5. The wheel assembly for roller skate as defined in claim 4, wherein the button has two ends, one end is exposed on an outer circumference of the sole and the other end connected to the singular locking member.

6. The wheel assembly for roller skate as defined in claim 4, further comprises a spring mounted around the button.

7. The wheel assembly for roller skate as defined in claim 1, wherein the pivotal seat is formed from a frame having at least one arm.

8. The wheel assembly for roller skate as defined in claim 7, wherein pivotal seat is formed from a frame having two arms which are parallel to a common plane and connected by an upper wall.

* * * * *